US008012308B2

(12) United States Patent
Ryu

(10) Patent No.: US 8,012,308 B2
(45) Date of Patent: Sep. 6, 2011

(54) MANUFACTURING METHOD OF MECHANICAL PULP FROM CORNSTALK CELLULOSE

(75) Inventor: Hai-il Ryu, Daejeon (KR)

(73) Assignees: Hai-il Ryu (KR); Hook Hong (KR)

( * ) Notice: Subject to any disclaimer, the term of this patent is extended or adjusted under 35 U.S.C. 154(b) by 0 days.

(21) Appl. No.: 11/916,826

(22) PCT Filed: Nov. 22, 2005

(86) PCT No.: PCT/KR2005/003954

§ 371 (c)(1),
(2), (4) Date: Dec. 7, 2007

(87) PCT Pub. No.: WO2006/132462

PCT Pub. Date: Dec. 14, 2006

(65) Prior Publication Data

US 2009/0020246 A1 Jan. 22, 2009

(30) Foreign Application Priority Data

Jun. 9, 2005 (KR) ..... 10-2005-0049302

(51) Int. Cl.
*D01C 1/00* (2006.01)

(52) U.S. Cl. ..... 162/96; 162/26; 162/83; 162/97

(58) Field of Classification Search ..... 162/96, 162/26, 83, 97

See application file for complete search history.

(56) References Cited

U.S. PATENT DOCUMENTS

| | | | | |
|---|---|---|---|---|
| 1,778,199 | A * | 10/1930 | Neumann | 162/80 |
| 1,846,511 | A * | 2/1932 | Darling | 162/24 |
| 5,944,953 | A | 8/1999 | Lavoie et al. | |
| 2004/0256065 | A1 * | 12/2004 | Ahmed et al. | 162/26 |

FOREIGN PATENT DOCUMENTS

| | | | |
|---|---|---|---|
| JP | 04057982 | | 2/1992 |
| KR | 2001001550 | | 1/2001 |
| NZ | 211684 | A1 * | 4/1986 |

OTHER PUBLICATIONS

Chinese Office Action dated Nov. 27, 2009 in connection with Chinese patent application No. 2005800500798, 4 pages.

"Study on wheat straw soda-anthraquinone two-stage cooking." Abstract of Reference 1 from Chinese Office Action dated Nov. 27, 2009 in connection with Chinese patent application No. 2005800500798, 6 pages.

"Properties and process of straw pulp horizontal tube continuous digester." Feb. 1, 1989; Abstract of Reference 2 from Chinese Office Action dated Nov. 27, 2009 in connection with Chinese patent application No. 2005800500798, 13 pages.

Korean Office Action dated Jun. 27, 2006in connection with Korean patent application 10-2005-0049302, 2 pages.

Nunweek, et al. "Manufacture of Cellulose Pulp: Second Digestion Step Follows Initial Digestion and Refining Steps." Apr. 4, 1985, Caxton, Paper Ltd. Abstract of Reference from Korean Office Action dated Jun. 27, 2006 in connection with Korean patent application 10-2005-0049302, 2 pages.

* cited by examiner

*Primary Examiner* — Eric Hug
*Assistant Examiner* — Jacob Thomas Minskey
(74) *Attorney, Agent, or Firm* — Occhiuti Rohlicek & Tsao LLP

(57) ABSTRACT

The present invention relates to a manufacturing method of mechanical pulp from stalks of corn, an annual plant, by adding a digesting agent and, prior to, during or following addition of the digesting agent, completely separating fibrous material from the cornstalks by mechanical refining. The method of the present invention comprises: (1) a first digesting process of adding 0.5-5 parts by weight of a digesting agent selected from caustic soda, sodium carbonate, sodium sulfite, sodium bisulfite, sodium sulfide, sodium oxide and sodium sulfate, or a digesting agent selected from a mixture of more than one of each to 100 parts by weight of crushed cornstalks, and of separating and digesting the solid substance after impregnating of the mixture; (2) a second digesting process of adding 5-10 parts by weight of more digesting agent to the digested solid substance obtained from the first digesting process, and of separating and digesting the solid substance after impregnating of the mixture; and a refining process of separating the solid substance to be digested and refining it mechanically, which is performed prior to, during or following the second digesting process.

2 Claims, No Drawings

MANUFACTURING METHOD OF MECHANICAL PULP FROM CORNSTALK CELLULOSE

This application is the National Stage of International Application No. PCT/KR2005/003954, filed on Nov. 22, 2005, which claims the benefit of Korean Application Serial No. 10-2005-0049302, filed on Jun. 9, 2005. The contents of both of the foregoing applications are hereby incorporated by reference in their entirety.

TECHNICAL FIELD

The present invention relates to a manufacturing method of mechanical pulp from cornstalk cellulose. More particularly, it relates to a method of manufacturing mechanical pulp from cornstalk cellulose by adding a digesting agent to stalks of corn, an annual plant, and, before, during or after addition of the digesting agent, refining the cornstalks mainly mechanically to completely separate cornstalk fibers.

BACKGROUND ART

With the rise of national income, Korea has become world s seventh largest paper (including publications, newspapers, publishing cardboards, kraft paper, bulk paper, etc.) consumer and at the same time world s ninth largest paper producer. However, it imports 100% of pulp, which is used to produce paper, from abroad. In an effort to meet the need for pulp materials, countries with poor forest resources like China, the Middle East and India are developing herbaceous agricultural wastes or bamboos into pulp materials, in the national level. Even the sugar cane dregs discarded after sugar making are developed into pulp materials.

A new pulp material should be developed because fostering pulp industry results in destruction of forest resources. To do so, cellulose present in a variety of plants should be processed and treated to improve their value as paper materials. Countries rich in forest resources separate fibrous cellulose from wood to produce paper pulp and dissolving pulp. Thus, over 90% of pulp produced across the world is made from wood.

However, with a plant distribution inappropriate for pulping and with a dearth of forest resources, Korea has to find a new strategy.

Corn grown in farms is used as food. But, cornstalks are mostly discarded even without being used as fodder. In the light of resources utilization and farmers income augmentation, cornstalks need to be processed and treated to be useful for pulp or other materials, for example, as in development of the Korean paper.

Each year, 750 million tons of cornstalks are produced worldwide. In the U.S. alone, some 150 million tons of cornstalks are produced a year. But, cornstalks are not used in pulping and paper-making industries, although 30 to 70% of them are adequate for paper making.

Pulps can be largely classified into mechanical pulp, semichemical pulp and chemical pulp, depending on the pulping process. Mechanical pulp is manufactured by dissolving wood by mechanical grinding in the presence of water. Acicular trees with long fiber length, such as spruce, fir, pine and black pine, are pulped by this method. Semichemical pulp is manufactured by steaming wood with a neutral sulfite solution and dissolving it through mechanical treatment. Light and soft trees, such as poplar, willow, linden tree, beech, oak, alder tree and ash tree, are pulped by this method. Chemical pulp is manufactured by adding a mixture solution of sulfurous acid and acidic sulfite to a fibrous material and digesting it. Trees with low resin content are manufactured into chemical pulp because of convenience in chemical treatment.

Usually, mechanical pulping requires less facility cost offers better yield and can be produced at a lower cost, compared with chemical pulp. Also, mechanical pulp is better than chemical pulp in view of pollution. However, mechanical pulp has worse quality than chemical pulp. Thus, if both quality and price are required, it is common to mix the two to obtain wanted pulp. With the improvement of mechanical pulp, basically derived from refiner mechanical pulp (RMP), now it can have properties comparable to those of chemical pulp. This mechanical pulp can replace all or part of chemical pulp. For example, Canadian Patent Nos. 1071805, 1145106 and 1145107 disclose methods for manufacturing mechanical pulp useful as replacement of chemical pulp. In the methods of these patents, thermal mechanical pulp (TMP), refiner mechanical pulp (RMP) or thermal chemical mechanical pulp (TCMP) that has passed through a refining process is treated with an sodium sulfite, a chemical for digesting, or mixed with the solution. Then, the treated pulp is further refined (an optional process) by digesting under applied pressure. U.S. Pat. No. 4,502,918 discloses a pulping method of treating wood particles with a sodium sulfite solution, digesting and refining the particles and separating pulp from the particles. French Patent No. 2544757 discloses a method of producing pulp from bagasse and bamboo. This method comprises at least two digesting processes. A digesting agent is added prior to each digesting process. This patent also comprises a blowdown process in between the digesting processes for separation of fascicular fibers.

Referring to prior researches related with cornstalks, U.S. Pat. No. 1,639,152 (1927), which was patented in the situation where quantitative experimentation was unavailable, discloses a pulping process which comprised separating fibroid material from cornstalks by microbial fermentation and extracting pulp using soda, lime and sulfite for use as lumber substitutes, wall boards, insulating materials, and so forth. Although the patent simply teaches that cornstalk can be digested and dissolved by such chemicals as soda, lime, sulfite, and so forth to make paper for newspapers, it does not mention anything about specific composition of the cornstalk digesting solution, amount of addition thereof, digesting temperature or digesting time. U.S. Pat. No. 1,845,487 discloses a process of preparing cellulose by digesting and dissolving plants with a small lignin content and a high pentosan (a pentose) content with dilute sulfuric acid or with sulfuric acid and a pressure of 10 pounds, and a pulping process of heating and pressing chipped or powdered cornstalks with a 1% sulfuric acid solution to remove water-soluble materials. U.S. Pat. No. 5,944,953 discloses a pulping process of cornstalks or straw encompassing both mechanical and chemical methods. It mentions using soda (NaOH), lime soda ($CaO_2$+NaOH) and neutral sulfite ($Na_2SO_2$+NaOH). Although not specifying the addition amount, it describes pulp making by refining cornstalks with 10-15 wt % of potassium hydroxide (KOH) and 1-5 wt % of potassium sulfite ($K_2SO_3$), based on the dry weight of cornstalk. Russian Patent No. 213995 describes a general herbaceous pulping process. This patent mentions nothing about solution composition, temperature or time of the digesting/dissolving process.

Thus, development of a method capable of effectively producing pulp from cornstalks is required.

DISCLOSURE OF INVENTION

Technical Solution

It is an object of the present invention to provide a manufacturing method of mechanical pulp from cornstalk cellulose by adding a digesting agent to stalks of corn, which is an annual plant, and, before, during or after addition of the digesting agent, refining the cornstalks mainly mechanically to completely separate cornstalk fibers.

The manufacturing method of mechanical pulp from cornstalk cellulose in accordance with the present invention comprises: (1) a first digesting process of adding 0.5-5 parts by weight of a digesting agent selected from caustic soda, sodium carbonate, sodium sulfite, sodium bisulfite, sodium sulfide, sodium oxide and sodium sulfate, or a digesting agent selected from a mixture of more than one of each to 100 parts by weight of crushed cornstalks, and of separating and digesting the solid substance after impregnating of the mixture; and (2) a second digesting process of adding 5-10 parts by weight of more digesting agent to the digested solid substance obtained from the first digesting process, and of separating and digesting the solid substance after impregnating of the mixture. It further comprises, before, during or after the second digesting process, a refining process of separating the solid substance to be digested and refining it mechanically.

BEST MODE FOR CARRYING OUT THE INVENTION

Hereunder is given a more detailed description of the present invention.

The manufacturing method of mechanical pulp from cornstalk cellulose in accordance with the present invention is characterized by comprising: (1) a first digesting process of adding 0.5-5 parts by weight of a digesting agent selected from caustic soda, sodium carbonate, sodium sulfite, sodium bisulfite, sodium sulfide, sodium oxide and sodium sulfate, or a digesting agent selected from a mixture of more than one of each to 100 parts by weight of crushed cornstalks, and of separating and digesting the solid substance after impregnating of the mixture; and (2) a second digesting process of adding 5-10 parts by weight of more digesting agent to the digested solid substance obtained from the first digesting process, and of separating and digesting the solid substance after impregnating of the mixture; and, before, during or after the second digesting process, a refining process of separating the solid substance to be digested and refining it mechanically.

That is, the present invention is characterized by manufacturing pulp from cornstalks through at least two digesting processes and at least one refining process. The invention is also characterized by performing two digesting processes and a refining process before or during feeding the cornstalk cellulose material into the refiner or after the first refining process by adding the sodium sulfite solution. The present invention is advantageous in that energy consumption in the digesting and refining processes is very little compared with conventional pulp producing methods and pulp with good properties is obtained. In accordance with the present invention, the digesting agent is added in two separated aliquots, preferably the addition amount is larger for the second addition than the first addition, and is added during the impregnation process, not the mixing process. The pulp obtained by the present invention has low fine-particle content and good strength.

The first digesting process (1) is performed by adding 0.5-5 parts by weight of a digesting agent selected from a group consisting of caustic soda, sodium carbonate, sodium sulfite, sodium bisulfite, sodium sulfide, sodium oxide, sodium sulfate and a mixture thereof to 100 parts by weight of crushed cornstalks, impregnating the mixture and separating and digesting the solid substance. The digesting may be performed by heating with steam. If the digesting agent is used in less than 0.5 part by weight per 100 parts by weight of the crushed cornstalks, effect of impregnation may be slight. Otherwise, if it is used in larger than 5 parts by weight of, yield of mechanical pulp may be low.

The second digesting process (2) is performed by adding 5-10 parts by weight of more digesting agent to the resultant mixture, impregnating the mixture and separating and digesting the solid substance. Again, the digesting may be performed by heating with steam. If the digesting agent is used in less than 5 parts by weight per 100 parts by weight of the crushed cornstalks, flexibility of pulp fiber may be poor. Otherwise, if it is used in larger than 10 parts by weight of, strength of pulp fiber may be not good.

In particular, the present invention is characterized by comprising a refining process of, before, during or after the second digesting process, separating and mechanically refining the solid substance to be digested. In the refining process, fibrous material is separated by mechanical grinding using a conventional refiner. It is understood that the refiner is one available in the market. Preferably, the refiner is a high-performance refiner, such as a conventional disc refiner, more preferably a pressurized double disc refiner, but not limited to them.

Hereinafter, the present invention is described in further detail through examples. However, the following examples are only for the understanding of the invention and the invention is not limited to or by them.

Example 1

Crushed cornstalks were treated in a steaming vessel of about 95° C. for 10 minutes. The condensate was drained and impregnation was performed at 50° C. for about 20 minutes by adding 3 parts by weight of sodium oxide per 100 parts by weight of the crushed cornstalks. After impregnation, the digesting solution was drained. Then, steam was directly fed to the impregnated cornstalks. Reaction was performed at about 130° C. for 10 minutes. The digested cornstalks were discharged using a screw conveyer and fed into a conventional pressurized double disc refiner. During the feeding, 10 parts by weight of sodium oxide, per 100 parts by weight of the crushed cornstalks, was added as digesting agent for the second digesting. The pulp/liquid mixture was transferred from the refiner to a cooking vessel and digested at 160° C. for about 60 minutes. The digested pulp was discharged and refined again. The refining processes were performed under a pressure of about 450 kPa.

Example 2

Procedure of Example 1 was repeated, except that 7 parts by weight of sodium oxide was added, per 100 parts by weight of the crushed cornstalks, as digesting agent during the feeding into the refiner for the second refining.

The pulps obtained in Examples 1 and 2 can be further refined to improve tensile strength, bursting strength and density. The pulp manufactured in accordance with the present invention can be used as replacement of chemical pulp wholly or in part. For example, it is adequate for a variety of paper including newspaper, tissue, printing paper, carton, etc., but is not limited to them.

The pulps obtained in Examples 1 and 2 had a tensile index of 20-47 Nm/G, a bursting strength of 0.6–3.5 $kPam^2/g$ and a density of 2-4 $kg/m^2$.

INDUSTRIAL APPLICABILITY

As apparent from the above description, the present invention is advantageous in that mechanical pulp can be manufactured from cornstalk cellulose by adding a digesting agent to stalks of corn, an annual plant, and mechanically refining the cornstalks before, during or after addition of the digesting agent to completely separate fibrous material from the cornstalks.

The invention claimed is:

1. A method of manufacturing mechanical pulp from cornstalk cellulose, the method comprising:

a first digesting process performed by adding 0.5-5 parts by weight of the digesting agent being sodium oxide only; and sodium oxide-as a digesting agent to 100 parts by weight of crushed cornstalks, impregnating the crushed cornstalks with the digesting agent, and separating and digesting the impregnated cornstalks to obtain a solid substance; sodium oxide as a second digesting process performed by adding 5-10 parts by weight of the digesting agent to the solid substance obtained from the first digesting process, impregnating the solid substance with the digesting agent, and separating and digesting the impregnated solid substance; and a refining process of separating the solid substance to be digested and refining it mechanically, which is performed before, during or after the second digesting process, wherein the refining process is performed under a temperature of 130 to 160° C. for 10 to 60 minutes without additional chemicals.

2. The method of claim 1, wherein the refining processes of separating the solid substance to be digested and refining it mechanically is performed before and after the second digesting process.

* * * * *